United States Patent [19]

Fuller

[11] 4,099,907

[45] Jul. 11, 1978

[54] IGNITION MECHANISM FOR A PYROPHORIC LIGHTER

[75] Inventor: David Lee Fuller, Atlanta, Ga.

[73] Assignee: Scripto, Inc., Atlanta, Ga.

[21] Appl. No.: 729,383

[22] Filed: Oct. 4, 1976

[30] Foreign Application Priority Data

Oct. 6, 1975 [GB] United Kingdom ..... 40816/75

[51] Int. Cl.[2] ..... F23Q 2/16

[52] U.S. Cl. ..... 431/254; 431/274

[58] Field of Search ..... 431/131, 142, 143, 150, 431/254, 274

[56] References Cited

U.S. PATENT DOCUMENTS

| | | | |
|---|---|---|---|
| 3,752,637 | 8/1973 | Norman et al. | 431/274 |
| 3,819,320 | 6/1974 | Chevallier | 431/254 |
| 3,825,401 | 7/1974 | Chevallier | 431/274 |

*Primary Examiner*—Carroll B. Dority, Jr.

*Attorney, Agent, or Firm*—Newton, Hopkins & Ormsby

[57] ABSTRACT

A spark producing mechanism for a pyrophoric lighter having a spark wheel which is actuated by a manually operable press button that is mounted for arcuate motion around the axis of the spark wheel wherein the button is a unitary molded plastic member that includes flexible webs that provide inter-bar pivots.

9 Claims, 2 Drawing Figures

26
28
12
5
25
8
10
11
27
2
3
9
13
15
24
22
4
16
14
23
17
7
20
18
1
6
19

IGNITION MECHANISM FOR A PYROPHORIC LIGHTER

BACKGROUND OF THE INVENTION

1. Field of the Invention

This invention relates to improvements in a manually operable ignition means for a pyrophoric lighter.

2. Description of the Prior Art

U.K. Pat. No. 1,397,326 discloses a lighter having a star-shaped ratchet wheel 5 and a pawl 11 that moves between an inoperative position to an operative position. The pawl 11 overrides the succeeding star point on ratchet wheel 5 upon its return movement.

U.S. Pat. No. 3,549,290 to Retzler discloses an activating member 4, an intermediate member 5, and a plastic yoke 36 which acts like a parallelogram linkage.

U.S. Pat. No. 3,752,637 to Norman et al. discloses a fingerpiece 23 connected to a carrier 22 by a molded plastic hinge 24.

U.S. Pat. No. 3,719,447 to Dessoy discloses a plastic operating lever.

In summary, the above four prior art patents disclose separately the following structural elements associated with an activating means: (1) a star-shaped ratchet and drive pawl, (2) a parallelogram-type linkage, (3) a plastic hinge, and (4) a plastic operating lever. However, they do not teach the structural combination or the mode of operation disclosed in the present application.

This invention relates to smokers' and like pyrophoric lighters of the type having a so-called flint from which a manually operated abrasive wheel strikes sparks to ignite fuel which, in modern lighters, is a gas, such as butane, which issues from a liquid reservoir through a burner opened by or on completion of the spark wheel operation.

In simple kinds of such lighters the spark wheel is operated by the user's thumb bearing on the wheel, or on side-flanges thereof, and then coming to rest on a burner-valve operating lever.

More elaborate lighters have a spring-loaded lever, for operation by the user's thumb or forefinger, to turn the spark wheel, usually through some form of pawl and ratchet mechanism, and encounter a burner-valve lever towards the end of the operating lever stroke.

Lighters which are operated by one manual lever, as compared with sequential manual operation of the spark wheel and then of a burner-valve lever, are known as automatic lighters and the objects of the invention are to facilitate the manufacture and assembly of operating mechanism for an automatic lighter and to improve ease of operation of the lighter.

SUMMARY OF THE INVENTION

This invention is applied to a pyrophoric lighter having a spark wheel actuated by a manually operable press button pivotally mounted for arcuate motion around the spark wheel axis and, according to the invention, the press button comprises one bar of a pivotal linkage which is a unitary molding of plastics material of which integral flexible webs provide inter-bar pivots.

The technical advantage of the invention is that the unitary molded linkage, forming the major part of the spark wheel actuating mechanism, can be made to accurate dimensional limits as a separate unit ready for assembly in a lighter, and the moving parts of the linkage do not require lubrication, are not liable to obstruction by flint dust and can be made to respond more smoothly to manual operation than parts which are mounted on slides or pivots.

In a preferred embodiment of the invention the press-button bar at its head carries a spark wheel ratchet drive pawl and at its foot is directly spring-loaded for return stroke motion after a manual depression stroke. The linkage is a substantially parallelogram linkage with a fixed bar, by which it is mounted in the lighter, and a pair of pivotal link bars connected by integral flexible webs to the press-button bar and fixed bar respectively. Preferably the pivotal link bars are arranged to move substantially parallel with the radius of the spark wheel ratchet tooth through which the drive pawl acts and the length of these bars is equal to or greater than that radius.

The spark wheel ratchet drive pawl is preferably a blade spring seated in a molded recess in the press button head and directed in the direction of the depression stroke so as to engage endwise in compression against and drive a spark wheel ratchet on a depression stroke and flex to pass the ratchet idly on the return stroke. The blade spring may be forked to provide a pair of limbs to engage each as a drive pawl respectively a ratchet on each side of the spark wheel.

BRIEF DESCRIPTION OF THE DRAWINGS

A preferred embodiment of the invention is illustrated, by way of example, on the accompanying drawings, in which.

DETAILED DESCRIPTION OF THE INVENTION

Figure 1:
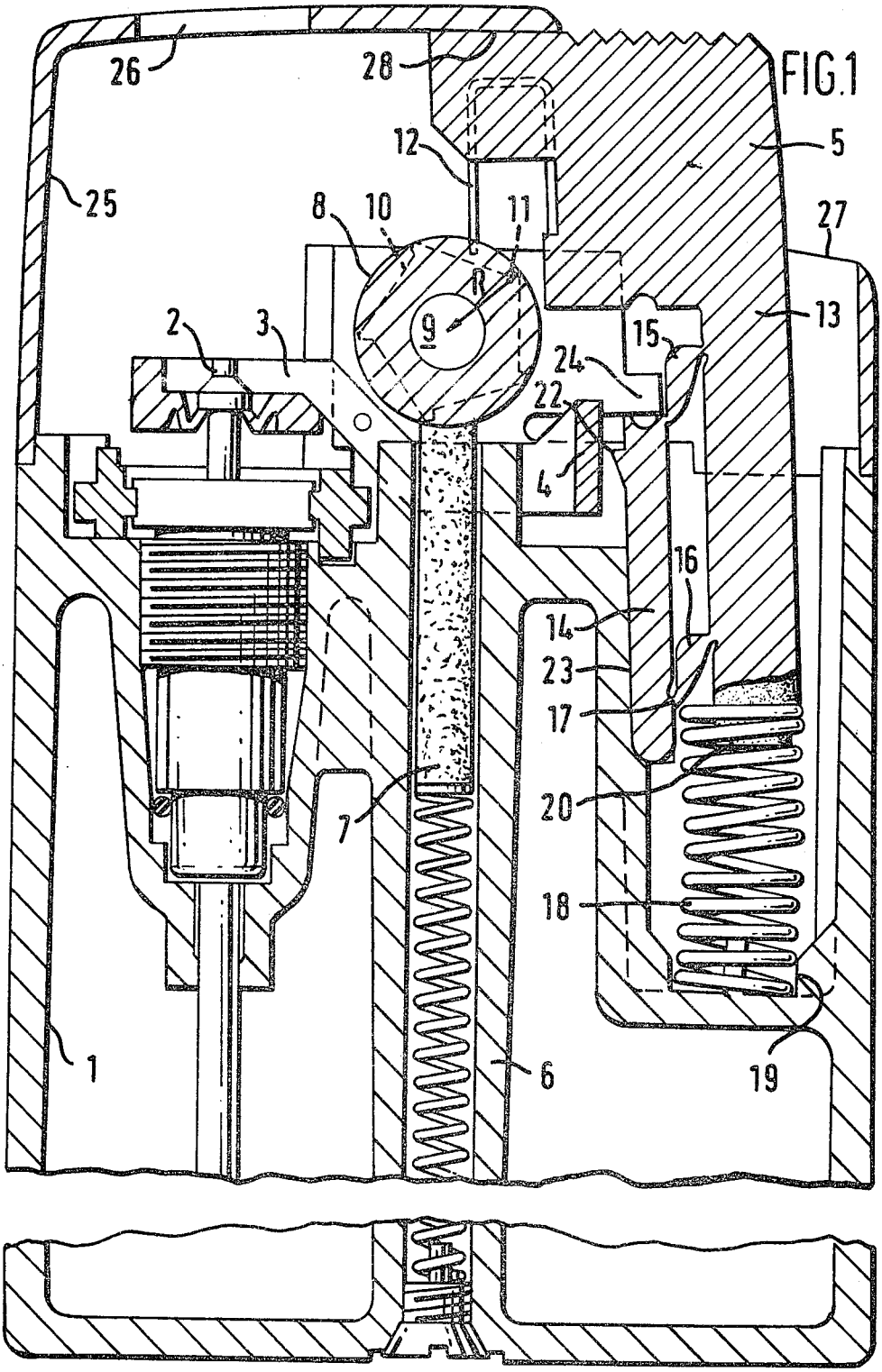
FIG. 1 shows, on an enlarged scale, the actuating mechanism of a pyrophoric lighter in sectional elevation in a plane parallel to the plane of the spark wheel.

The lighter shown has a body 1 which forms or contains a liquified gas reservoir from which gaseous fuel is emitted through a burner 2 under the control of a valve operated by a forked rocking lever 3 with an actuating arm 4 in the path of a press button 5 towards the end of its depression stroke.

The valve lever 3 spans the head of a flint tube 6 in which a flint 7 is spring-loaded to bear upwardly against a serrated spark wheel 8 on an axis pin 9.

To drive the spark wheel 8 on each side thereof is a coaxial ratchet disc 10 with teeth 11 at angular intervals corresponding to a rotation of the spark wheel effective to propel a stream of sparks into the gas jet above the burner 2. In the embodiment shown there are five teeth 11 to give, at each actuation, an effective rotation of 72°.

Figure 2:
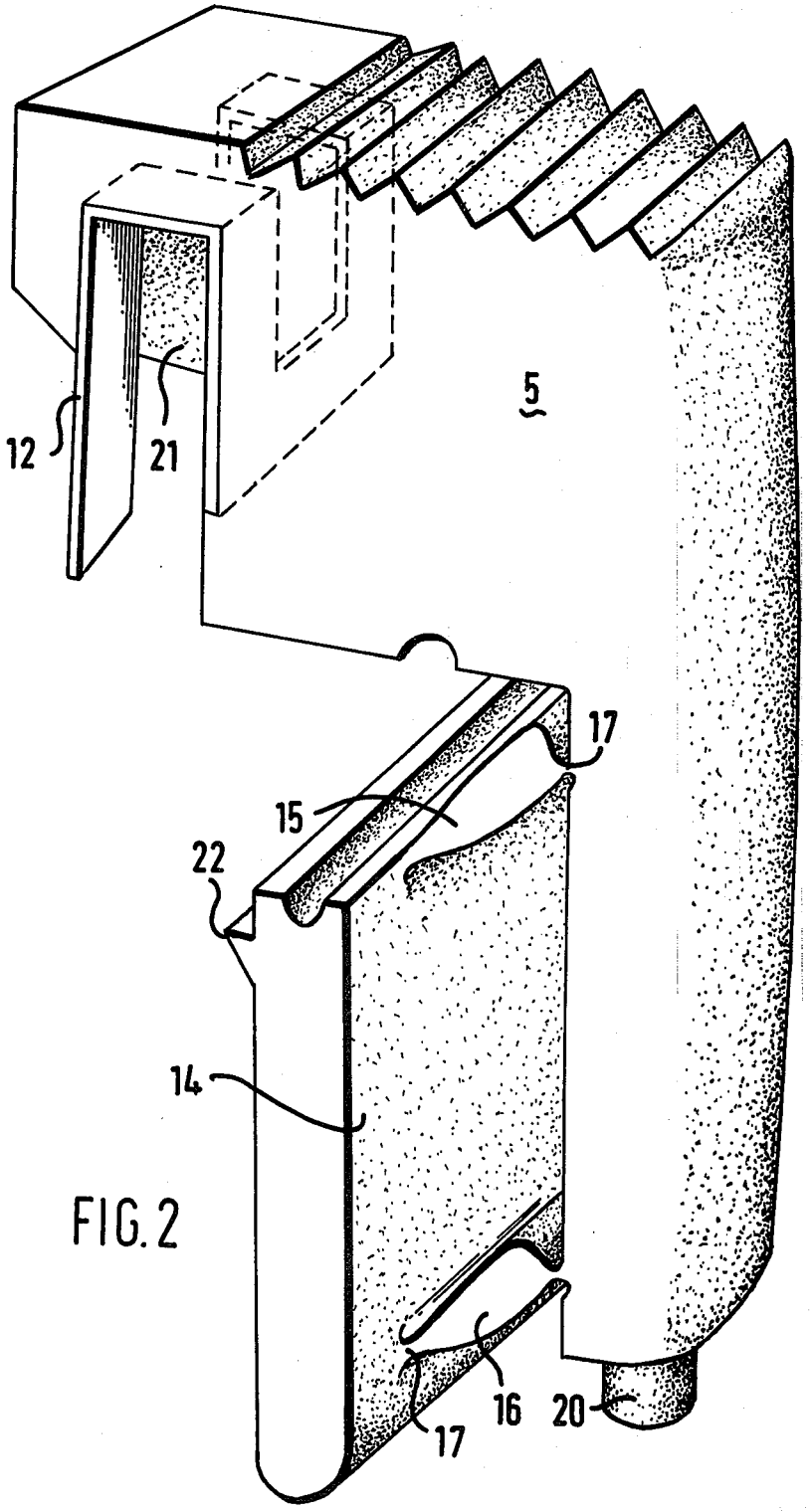
FIG. 2 is a perspective view of the press button and its linkage molded as an integral unit.

The ratchets 10 are both driven by a forked blade spring 12 with a pair of limbs each directed in the direction of the depression stroke of the press button 5 so as to engage endwise in compression, as a rigid pawl, against the first tooth 11 which it encounters. During the depression stroke the drive spring 12 acts through the radius R of the ratchet which it engages and moves parallel to itself with the press button 5 which is an integral head of one bar 13 of a four-bar parallelogram linkage, see FIG. 2, of which the opposite bar 14 is a fixed or static bar mounted fast in the lighter body 1. The link bars 15 and 16 pivot, through flexure of integral thin webs 17, to guide the press button 5 in arcuate parallel motion about the axis of the ratchets 10 and spark wheel 8. The effective length of the link bars 15 and 16 is equal to or greater than the radius of the teeth 11, the range of such radius being from about 65% to 100% of the length of the bars 15 and 16, this being found to promote reliable operation. The bars 15 and 16 are arranged substantially parallel to the radius R through which the drive spring acts.

The press button is normally held at the top of its stroke by a coiled compression spring 18 seated in a socket 19 in the lighter body 1 and engaging around a spigot 20 at the foot of the press button bar 13 which thus has freedom for its arcuate movement unconstrained by the spring 18.

It will be seen that the press button linkage can be molded as a separate integral unit (FIG. 2) and, with the blade spring 12 in place in a seating recess 21, can be inserted in the lighter body in which it is located and retained by the fixed bar 14, and a tongue 22 molded thereon, engaged as a dovetail in a lateral seating recess 23 and beneath end retaining lugs 24 in the body 1.

The upper part of the lighter is covered by a metal cap 25 with a flame port 26 and a cut-away corner 27 at which the press button 5 is accessible for manual depression. The return stroke of the press button 5, under the thrust of the spring 18, is limited by abutment against the cap at 28.

In operation, thumb or finger pressure on the press button 5 depresses it for the limbs of the drive spring 12 to encounter the first tooth 11 of the respective ratchet disc 10 and rotate the spark wheel 8 to abrade the flint 7 and propel a stream of sparks towards the gas jet above the burner 2 through which gas is released by abutment of the press button 5 against the arm 4 of the valve lever 3. During the depression stroke the limbs of the drive spring 12, possibly slightly bowed under load, remain substantially parallel to themselves but move arcuately with the press button bar 13 until, at the bottom of the depression stroke, they lie flat against the respective side of each ratchet disc 10. On release of the press button, the return spring 18 lifts the press button to the top of its stroke on the approach to which each limb of the drive spring flips over the next tooth 11 ready for the next actuation.

It should be understood that the just described embodiments merely illustrate principles of the invention in a preferred form. Many modifications, deletions and additions may, of course, be made thereto without departure from the spirit and scope of the invention as set forth in the following claims.

What is claimed is:

1. In a pyrophoric lighter having a spark wheel with ratchet teeth actuated by a manually operable press button pivotally mounted for arcuate motion around the spark wheel axis the improvement characterized by said press button comprising a unitary molded pivotal linkage having a plurality of bar portions and integral flexible webs pivotally inter-connecting adjacent bar portions.

2. In a lighter according to claim 1 and further characterized in that said linkage includes a press-button bar, a fixed bar mounted in the lighter, and a pair of pivotal link bars positioned between the press-button bar and the fixed bar respectively.

3. In a lighter according to claim 2 and further characterized in that said press-button bar has a head and a foot and at its head carries a spark wheel ratchet drive pawl, and a spring means biased against said foot for return stroke motion after a manual depression stroke.

4. In a lighter according to claim 3 and further characterized in that said pivotal link bars are of a length equal to or greater than the radius of the ratchet teeth.

5. In a lighter according to claim 2 and further characterized in that said spark wheel ratchet drive pawl is a blade spring mounted in the press button head and directed in the direction of the depression stroke so as to engage endwise in compression against and drive a spark wheel ratchet on a depression stroke and flex to pass the ratchet idly on the return stroke.

6. In a lighter according to claim 5 in which the blade spring is forked to provide a pair of limbs to engage respectively a ratchet tooth on each side of the spark wheel.

7. In a lighter according to claim 2 and further characterized in that said pivotal link bars are arranged to move substantially parallel with the radius of the spark wheel tooth which is engaged by the drive pawl.

8. In a lighter according to claim 1 and further characterized in that said plural bar linkage is a parallelogram.

9. In a lighter according to claim 1 and further characterized in that said plural bar linkage is a quadrilateral.

* * * * *